US008397734B2

(12) United States Patent
Mennella

(10) Patent No.: US 8,397,734 B2
(45) Date of Patent: Mar. 19, 2013

(54) METHOD AND SYSTEM FOR COLORING AND CUTTING HAIR

(75) Inventor: George Mennella, Dix Hills, NY (US)

(73) Assignee: Geoblazeon Creative Technology LLC, Dix Hills, NY (US)

( * ) Notice: Subject to any disclaimer, the term of this patent is extended or adjusted under 35 U.S.C. 154(b) by 546 days.

(21) Appl. No.: 12/335,266

(22) Filed: Dec. 15, 2008

(65) Prior Publication Data

US 2009/0283105 A1 Nov. 19, 2009

Related U.S. Application Data

(60) Provisional application No. 60/996,974, filed on Dec. 13, 2007.

(51) Int. Cl.
*A45D 7/00* (2006.01)
*A45D 24/34* (2006.01)
*A45D 24/36* (2006.01)

(52) U.S. Cl. ..... 132/200; 132/213; 132/214

(58) Field of Classification Search ..... 132/212, 132/213, 213.1, 214, 270, 200, 229, 266, 132/272, 234, 235, 236
See application file for complete search history.

(56) References Cited

U.S. PATENT DOCUMENTS

| | | | | |
|---|---|---|---|---|
| 2,558,516 | A * | 6/1951 | Granberg | 132/213 |
| 2,718,231 | A * | 9/1955 | De Lano | 132/213 |
| 2,765,796 | A * | 10/1956 | Guenther | 132/213 |
| 2,949,920 | A * | 8/1960 | Humphrey | 132/213.1 |
| 3,015,336 | A * | 1/1962 | Caples | 132/213 |
| 3,180,341 | A * | 4/1965 | Dumont | 132/213 |
| 3,586,009 | A * | 6/1971 | Sirmons | 132/270 |
| 3,599,647 | A * | 8/1971 | Fabbri | 132/270 |
| 4,665,933 | A * | 5/1987 | Zinger et al. | 132/270 |
| 5,433,225 | A | 7/1995 | Liggett | |
| 5,494,057 | A * | 2/1996 | Gianfrancesco | 132/214 |
| 5,819,766 | A * | 10/1998 | Craigen | 132/314 |
| 5,954,063 | A * | 9/1999 | Pomaro | 132/213 |
| 2005/0039768 | A1 | 2/2005 | Winckels | |
| 2006/0144415 | A1 * | 7/2006 | Magee | 132/270 |

FOREIGN PATENT DOCUMENTS

| | | |
|---|---|---|
| EP | 1495694 | 1/2005 |
| JP | 03-016446 | 7/1995 |

* cited by examiner

*Primary Examiner* — Robyn Doan
(74) *Attorney, Agent, or Firm* — Seth Natter; Natter & Natter

(57) ABSTRACT

A palette assembly of one or more vertically arranged substantially flat palettes with a central aperture for cutting and/or coloring hair. Layers of hair are spread across the surface of the palette for cutting and/or coloring in a desired pattern, whereby hair color can be applied onto strands of hair in a desired specific pattern, or the hair may be cut according to a desired specific pattern, each of which can be easily replicated. Markings on the surface of the palette indicate the location of a cut or a particular shade of color, to create a particular hairstyle or color.

20 Claims, 13 Drawing Sheets

METHOD AND SYSTEM FOR COLORING AND CUTTING HAIR

CROSS-REFERENCE TO RELATED APPLICATIONS

This application claims priority to U.S. Provisional Application No. 60/996,974 titled ADVANCED METHOD AND SYSTEM FOR SIMULTANEOUS COLORING AND CUTTING HAIR filed on Dec. 13, 2007, the entirety of which is incorporated by reference herein.

BACKGROUND OF THE INVENTION

1. Field of the Invention

Aspects of the present invention relate generally to an apparatus for coloring and cutting hair, and for precisely replicating a specific hairstyle and/or color. Aspects of the present invention also relate generally to a method of cutting and coloring hair with the apparatus of the present invention.

2. Description of the Related Art

In existing methods for coloring hair in more than one shade of color, square pieces of foil are used to process the color. The hair is divided into sections, color is applied and foil pieces are folded over the colored hair for processing. A single color or shade is applied to each section of hair in the foil.

However, while the hair is in the foil pieces, the hair cannot be cut. In addition, the stylist is unable to see the entire head of hair and the effect of the color during processing because the hair is enclosed within the foil pieces. For example, the stylist is limited to using only one shade of color at a time and cutting must be performed separately because the hair is enclosed within the foil pieces. Further, once the hair has been cut and/or colored, it is difficult to precisely replicate a desired hairstyle and/or hair color. There is a need in the art, therefore, for an apparatus and method for using more than a single shade of color in one coloring process, for simultaneously coloring and cutting hair, and for precisely replicating a specific hairstyle (e.g., a specific shape and/or form of the hair) or a specific hair color.

SUMMARY OF THE INVENTION

Aspects of the present invention solve the above problems, and others, by providing a palette assembly for cutting and/or coloring hair that reduces the amount of time required to cut and color hair by combining both processes and performing them simultaneously, for example. Further, aspects of the present invention provide a palette assembly for cutting hair according to exact specifications (e.g., shape, style and/or form). In addition, aspects of the present invention provide a method and system for coloring hair according to exact specifications (e.g., specific shades of color, on precise hair strands/locations). Aspects of the present invention also provide the tools necessary to create the desired style, shape, form and/or color using the palette assembly of the present invention.

In particular, the present invention includes a palette assembly formed from a plurality of substantially flat palettes that are arranged vertically on the head of hair to be styled. The palettes have a central aperture to encircle the head. A securing mechanism, such as a gasket, is applied to the inner edge of the aperture to provide a smooth surface between the palette and the head and also to prevent any color from dripping between the gasket and the skin. Layers of hair are spread across the surface of the palette for cutting in a desired pattern and/or coloring, whereby a hair color product can be painted onto the strands of hair in a desired specific pattern, which can be easily replicated. Further, the hair may also be cut according to a desired specific pattern, which can also be easily replicated. The surface of the palette can have indicators, such as markings or grooves in order to indicate the location of a cut to create a particular style, shape, form and/or shade of color.

The remaining hair, before being spread onto the palette is held in place, for example, in an upward position over the crown of the head, by a holding mechanism, such as a free-standing assistant or other similar mechanism that achieves the purpose of drawing the remaining hair away from the palette assembly. The free standing assistant may include, for example, a telescoping body mounted on a base and may have a goose-neck attachment at an upper end of the telescoping body for flexibly holding a portion or portions of the hair while the stylist prepares layers of the hair on the palette assembly. The base of the free-standing assistant may be mounted on casters, for example, so that the free-standing assistant can roll to the desired position around the head to be colored and cut. The free-standing assistant may have a removable tray and basket for holding styling implements and/or color products.

Additional advantages and novel features of the invention will be set forth in part in the description that follows, and in part will become more apparent to those skilled in the art upon examination of the following or upon learning by practice of the invention.

BRIEF DESCRIPTION OF THE DRAWINGS

In the different figures, the same reference numerals designate identical or similar features or components. The features of the invention will be more readily understood with reference to the following description and the attached drawings, wherein.

DETAILED DESCRIPTION

Figure 1:
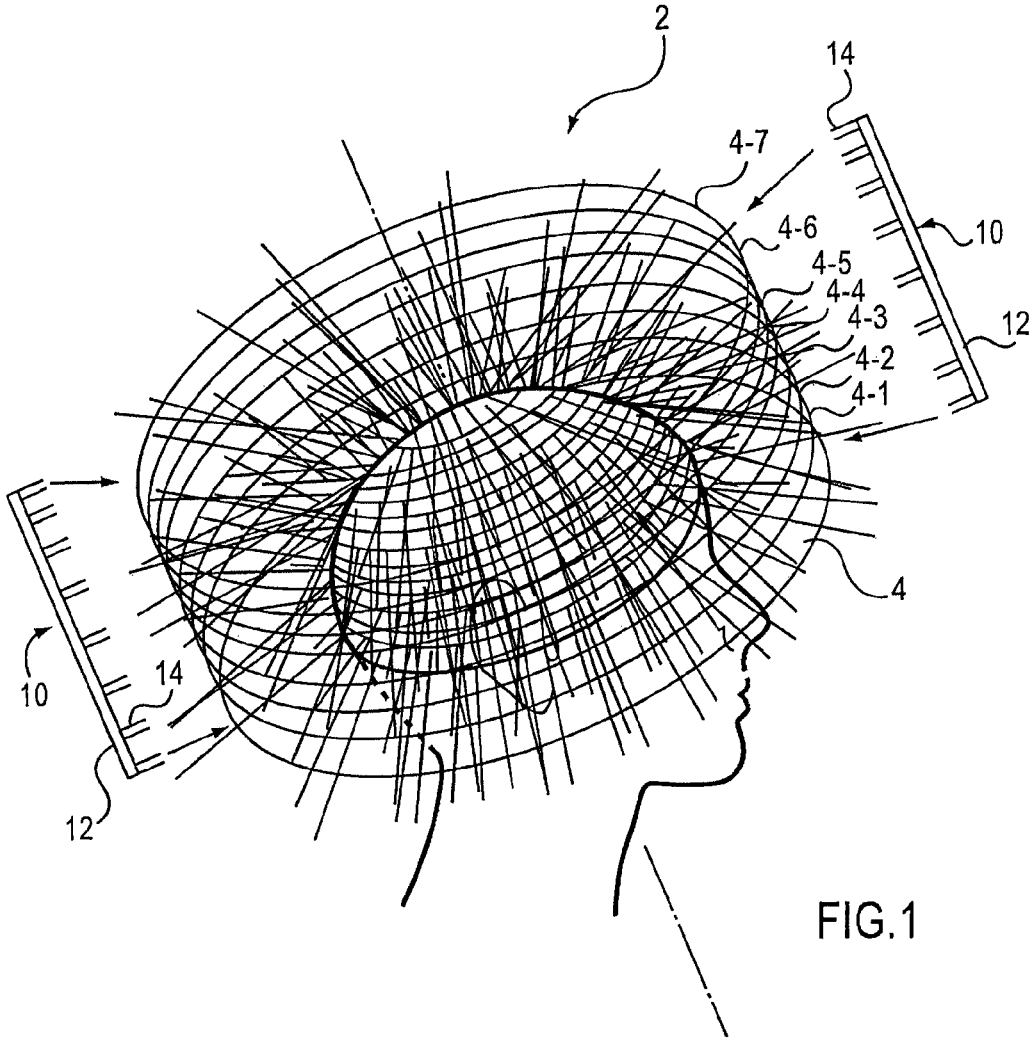
FIG. 1 illustrates the completed palette assembly, according to aspects of the present invention.

An aspect of the present invention is directed to a hair cutting and coloring palette assembly 2 for hairstyling, as shown in FIG. 1. Palette assembly 2 includes a plurality of substantially flat palettes 4 to 4-7, having central apertures 8 to 8-7 for inserting the hair covered portion of the head to be styled. The palettes 4 to 4-7 of the palette assembly 2 may be arranged vertically, in layers, to encircle the head to be styled. Alternatively, a single palette having an aperture may be used.

In accordance with aspects of the present invention, palettes 4 to 4-7, illustrated in FIGS. 2 and 3A to 3G, are shown as having an oval shape; however, the palettes can have any shape including, but not limited to, round, rectangular, triangular, hexagonal, or any other desired shape. The palettes can also have straight or curved outer edges. The palettes 4 to 4-7 can form a template for a particular style so that the stylist can replicate the style and/or color for a plurality of heads and/or colors, or use the template as a teaching tool.

In the subsequent palettes 4-1 to 4-7, on accordance with one aspect, the central apertures 8-1 to 8-7 of FIGS. 3A to 3G are illustrated as having different sizes to fit different sized heads, different contours of the head and different areas of the head. For example, the first palette 4 can have a central aperture 8 that fits around the hairline at the forehead, while the second palette 4-1 can have a smaller sized aperture 8-1 that fits a vertically higher plane of the head. A third palette 4-2 can have a central aperture 8-2 smaller than the central aperture 8-1 in the second palette 4-1 for fitting a vertically higher plane of the head. Subsequent palettes 4-3 can have incrementally smaller central apertures approaching the crown to secure such palettes to the head as the head narrows toward the crown. Any number of palettes can be used in the palette assembly 2 depending upon the desired style. In accordance with aspects of the present invention, all palettes may have apertures of the same size.

The central aperture 8 of the palette 4, as a representative example of the palettes 4-1 to 4-7 of an aspect of the present invention, can be sized to encircle different sized heads and different areas of the head. For example, central aperture 8 can be sized to encircle the head at the forehead, at the crown, and areas in between. The central aperture 8 forms an inner edge 4*a* of the palette 4. The brim of the palette 4 has an outer edge 4*b*. The surface of the palette 4 can be formed into any size or shape depending on the length of the hair and other conditions, such as the style to be created through the cutting and/or coloring process and the desired locations of different colors or highlights for the head to be styled.

In accordance with aspects of the present invention, palette 4 can be formed from a plastic material. Other materials for the palette include, but are not limited to metal, wood, ceramic tile or any other material that can support the weight of hair on a head to be styled. In one aspect of the present invention, the palette 4 material is rigid. In another variation, the palette 4 material is flexible. The palette 4 can have any type of appearance such as opaque or transparent. A transparent palette provides the stylist with an overall view of the styling of each layer of hair in the palette assembly 2.

In accordance with aspects of the present invention, each palette 4 can have a template, such as markings or grooves etched into the surface thereof, painted, printed, or otherwise indicated on the palette surface to indicate where and how a section of hair should be cut and/or colored to create a particular style. The palette 4 can also have a straight, curved or serrated edge to separate the section of hair being colored and/or cut.

The palette 4 can be sized to the head to be styled, for example, by applying a removable securing mechanism 6, such as a gasket, to an inner edge 4*a* of the palette 4. The securing mechanism 6 provides a smooth surface for securing the palette to the head to be styled.

In one aspect, palette 4 may be a rigid or flexible board of any suitable material, such as plastic, metal and/or wood, that allows the hair to be spread on a surface thereof, which is removably held in proximity to the head to be styled via any securing mechanism 6, e.g., a gasket, hook and loop fasteners, Velcro® strips, clips, snaps, elastic bands, or held in place manually. Securing mechanism 6 also allows the palette 4 to be sized to the head being styled.

In one aspect, the securing mechanism 6, such as a gasket, has an inner surface 6*a*, which contacts the head to be styled when used. The securing mechanism 6 can have any shape in which the outer surface thereof conforms with the shape of the inner edge of the central aperture in the palette. The outer surface 6*b* of the securing mechanism 6 adheres to the inner edge 4*a* of the palette 4. The securing mechanism 6 can be fastened to the palette 4 by an adhesive member, such as a peel and stick adhesive. The peel and stick adhesive includes an adhesive member 66 mounted on the securing mechanism 6 that is covered by a strip of non-stick material that protects the adhesive until the adhesive is applied to the desired surface. Removal of the non-stick material uncovers the adhesive material on the securing mechanism 6 so that the securing mechanism can stick to the inner edge 4*a* of the palette.

In accordance with one aspect, securing mechanism 6 can be a gasket formed of a hypoallergenic rubberized material that is secured to the inner edge 4*a* of the palette 4. The securing mechanism 6 can also be a solid tubular member 66 that has, for example, a circular cross-section. Alternatively, the securing mechanism 6 can be formed to have a groove along an outer surface thereof for press-fit insertion of the inner edge 4*a* of the palette 4. The inner surface 6*a* of the securing mechanism 6 can be pressed against the head to be styled.

Figure 2:
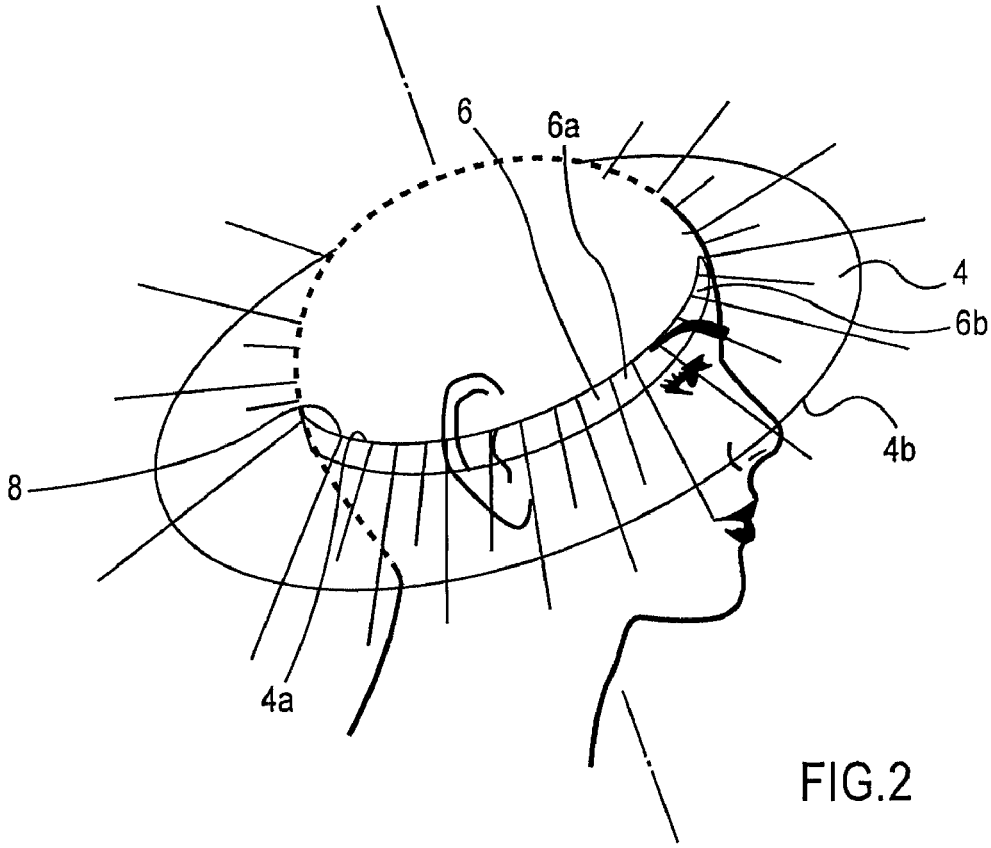
FIG. 2 illustrates an exemplary first palette according to aspects of the present invention.
Figure 3A:
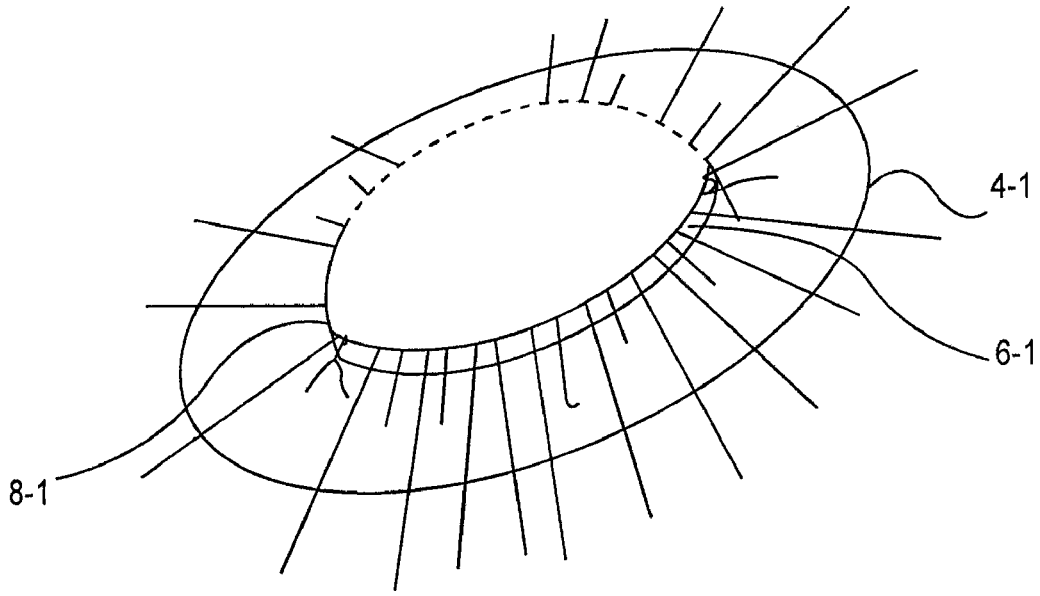
FIGS. 3A to 3G illustrate the exemplary second palettes, according to aspects of the present invention.
Figure 3B:
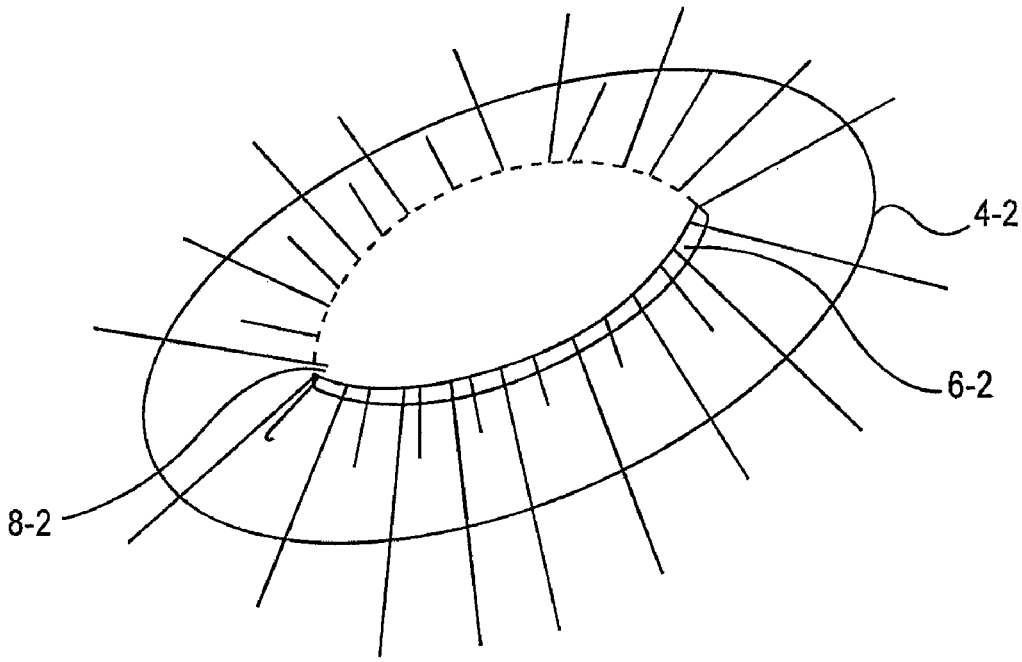
Figure 3C:
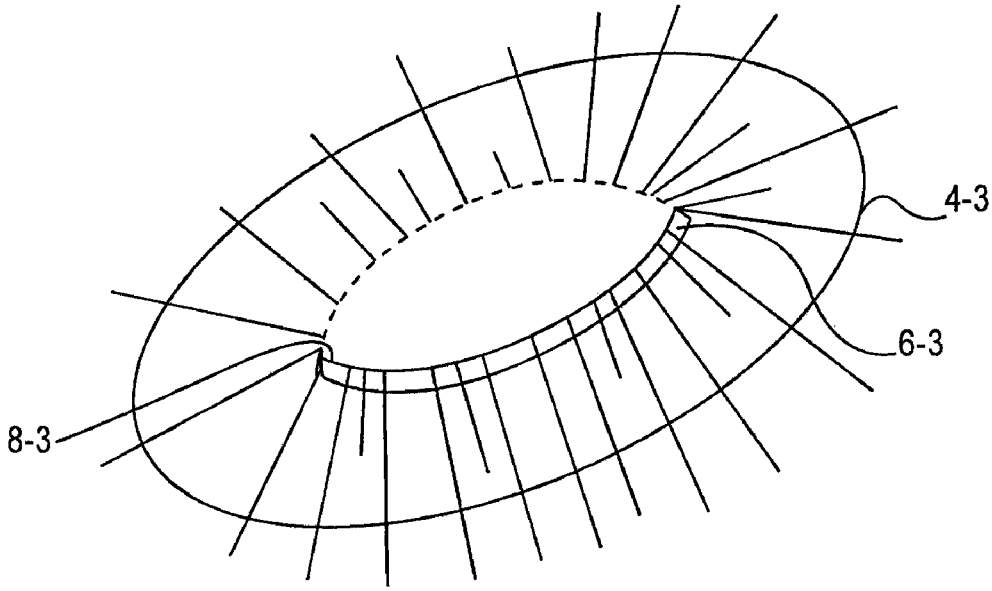
Figure 3D:
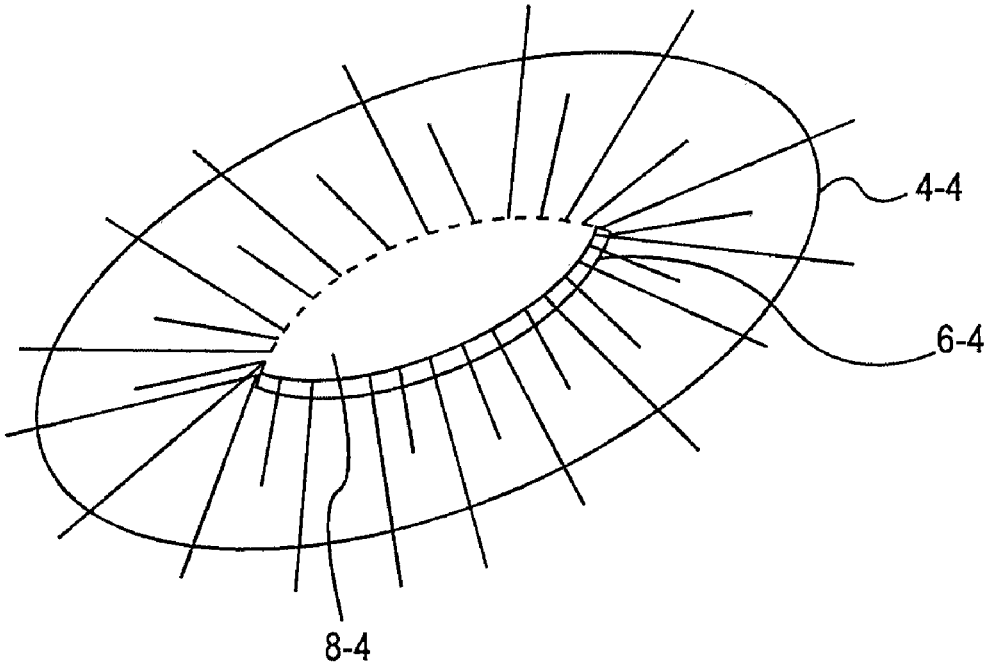
Figure 3E:
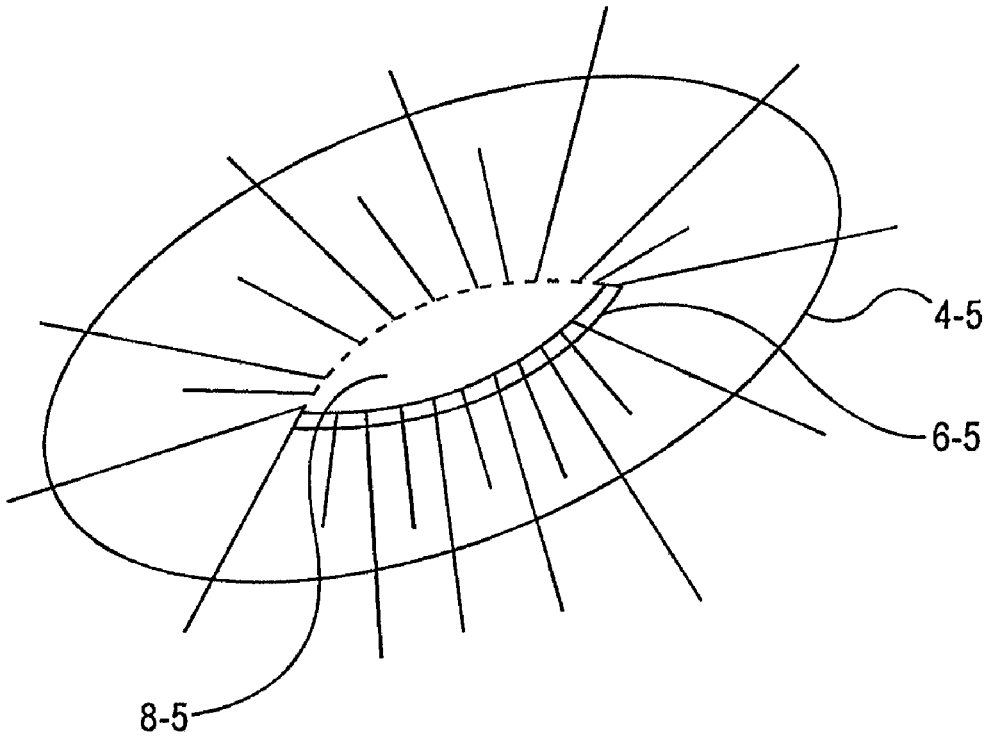
Figure 3F:
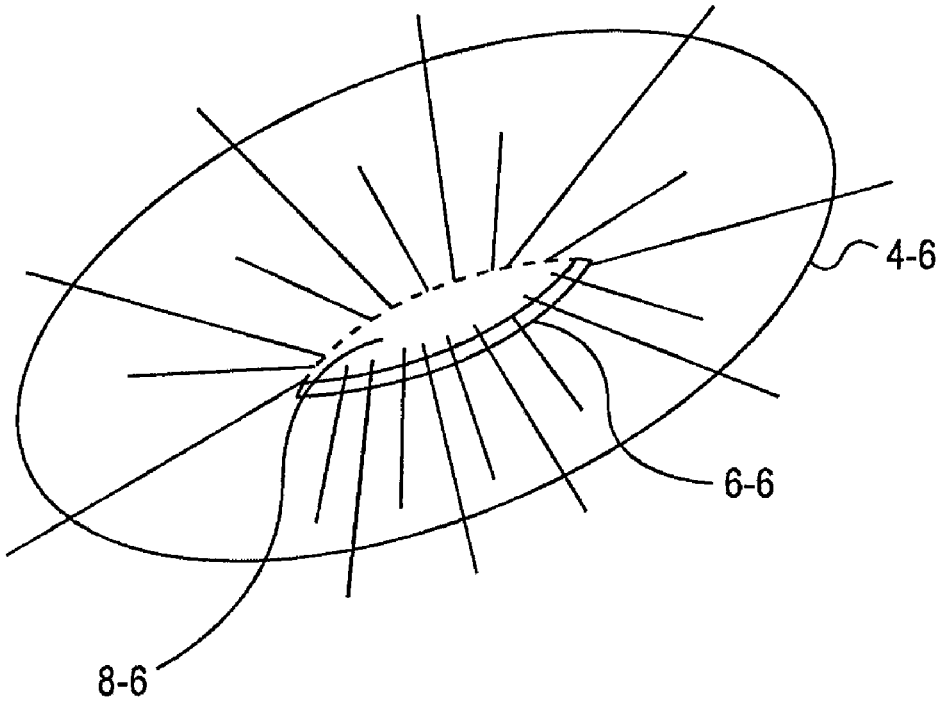
Figure 3G:
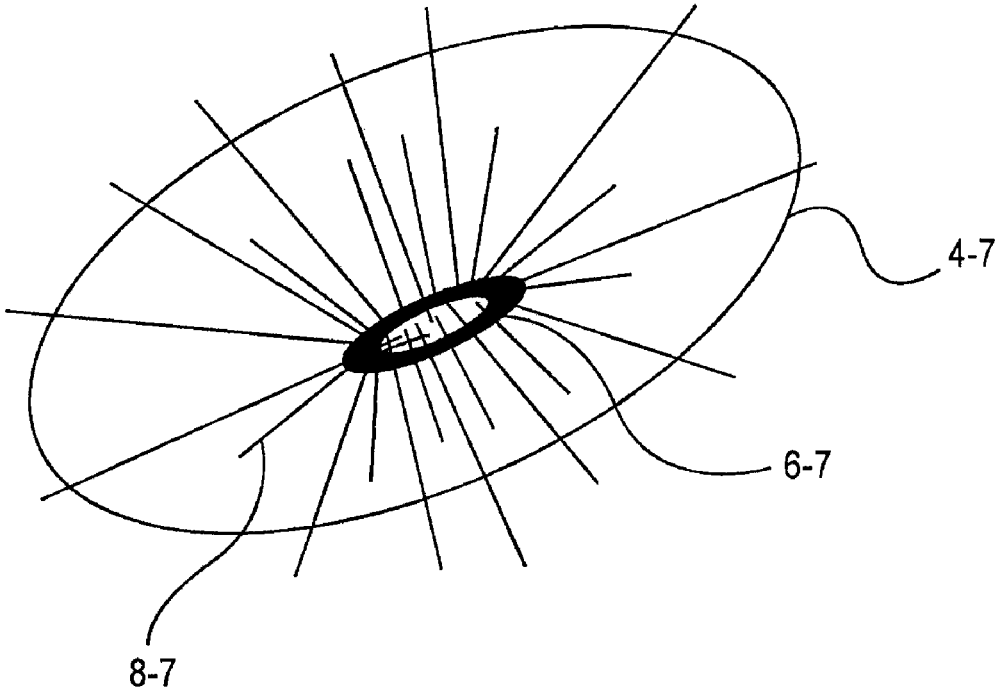

In operation, in aspects of the present invention, palettes 4 to 4-7 of the palette assembly 2 can be arranged by placing, for example, a first palette over the hair on the head to be styled, as shown in FIG. 2. The central aperture 8 of the first palette 4 applied to the head is sized to encircle the head above the forehead. The gasket 6 attached to the inner edge 4*a* of the first palette secures the first palette to the head to be styled. A first layer of the hair, such as, for example, the outermost ring portion of the hair, such as at the hairline can spread over the first palette 4 for cutting and/or coloring. An exemplary second palette 4-1 is arranged over the first palette 4 and secured to the head. The second palette 4-1 can have a central aperture 8-1 that is smaller than the central aperture 8 of the first palette where the diameter of the upper portion of the head is smaller than the diameter of the head around the forehead. The second palette 4-1 can be placed directly on top of the first layer of hair and a second layer of hair can be spread over the second palette for cutting and/or coloring. The second palette 4-1 also has a gasket 6-1 secured to the inner edge 4-1*a* thereof.

In accordance with aspects of the present invention, subsequent palettes, 4-2 to 4-7 as shown in FIGS. 3A to 3G, may be arranged in overlapping series in the same manner on the head. As each palette 4-2 to 4-7 is arranged above a previous palette, another layer of hair closer to the crown of the head is spread on the palette for cutting and/or coloring. The remaining hair on the head to be styled is drawn away from the palettes 4 to 4-7 by a stylist, a free-standing assistant, or by a holding mechanism such as a rubber band, as will be discussed in more detail below, above the crown of the head, for example, while the first, second and subsequent layers are spread on the respective first 4, second 4-1 and subsequent 4-2 to 4-7 palettes. The layers of hair spread on each palette 4 to 4-7 are portions of the remaining hair held by the stylist, the free-standing assistant or other mechanism for holding the remaining hair away from the face.

After all of the palettes necessary for a particular style (which may be, e.g., a single palette) are applied to the head, in accordance with aspects of the present invention, the palettes can be clipped or otherwise attached and held in place via attachment mechanism 10 to maintain the arrangement of the palette assembly 2 in place. The attachment mechanism 10 may comprise, e.g., hook and loop fasteners, Velcro® strips, clips, snaps, elastic bands, or held in place manually. The attachment mechanism 10 may comprise grooves or indentations on the surface of the palettes, which, when stacked, operate to maintain the arrangement of the palette assembly 2 in place.

In accordance with one aspect, FIG. 1 shows attachment mechanism 10, such as ladder clips. Each ladder clip 10 is formed in the shape of a comb and has a spine 12 and a plurality of pairs of teeth 14 spaced apart to the thickness of the palettes 4 to 4-7 to clip onto the outer edge 4*b* to 4-1*b* of the vertically arranged palettes. The ladder clip 10 can be made from any material including, but not limited to plastic, aluminum, stainless steel, other metals, wood or any combination thereof, and may be flexible or rigid. Although FIG. 1 shows two ladder clips 10 for securing the palette assembly 2, any number of ladder clips can be used together in any number of combinations, for example, by fastening the ladder clips to each other along the spine 12.

When the hair processing including cutting and/or coloring is complete, in accordance with an aspect of the present invention, palette assembly 2 can be disassembled by first removing the ladder clips 10, and then each palette 4 to 4-7.

Figure 4:
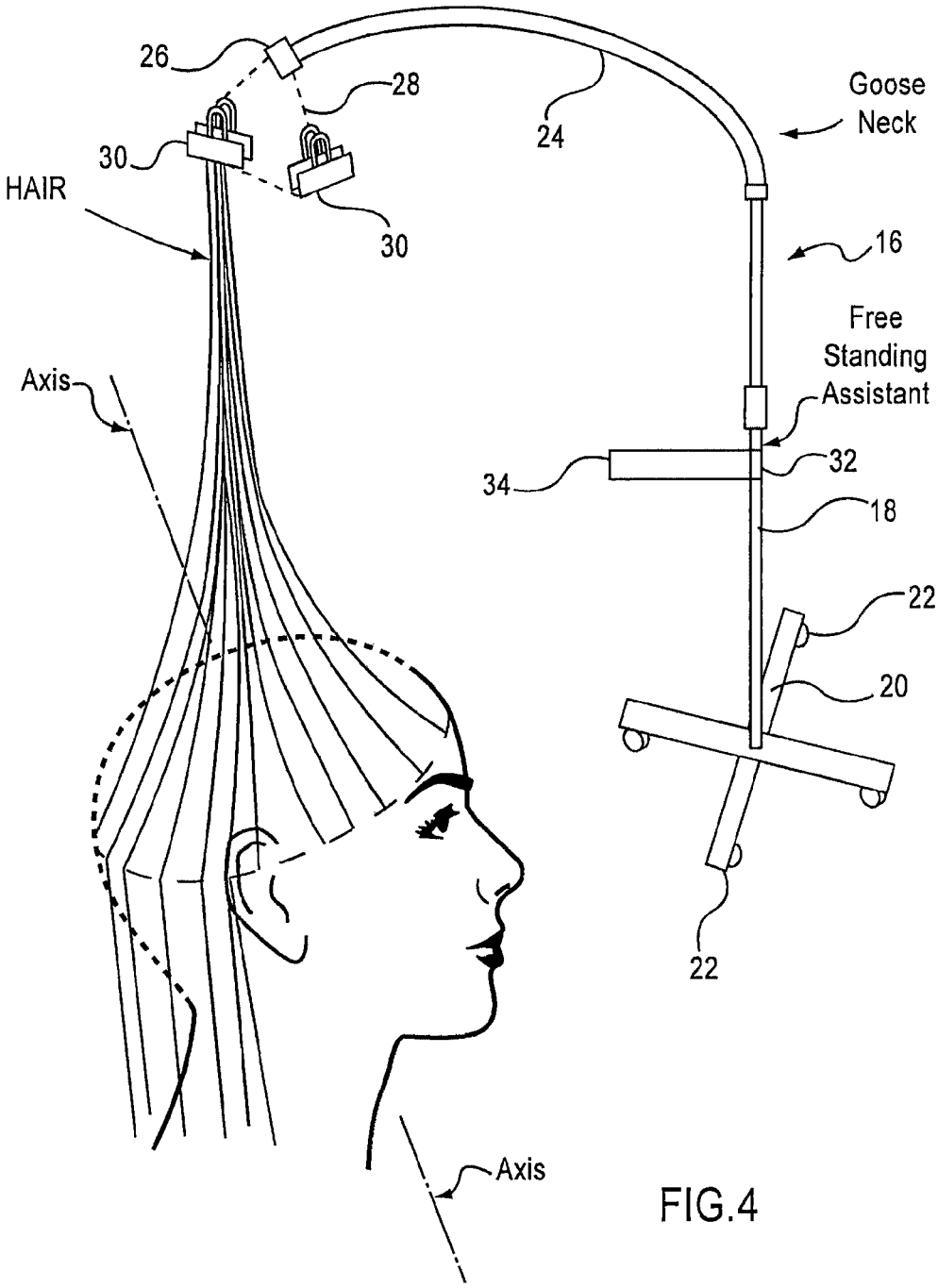
FIG. 4 illustrates the free-standing assistant, according to aspects of the present invention.

In aspects of the present invention, a free standing assistant 16 as shown in FIG. 4, may be used to hold the remaining hair on the head to be styled while the first, second and/or subsequent layers are being spread on the respective first 4, second 4-1 and subsequent 4-2 to 4-7 palettes. The free-standing assistant 16 may include a telescoping body 18 that may be mounted on a base 20. The base 20 can include a cross-beam, for example, as show in FIG. 4, for balancing. The base has casters 22 so that the free-standing assistant 16 can be rolled to the desired position.

As shown in FIG. 4, at a top end of the telescoping member 18 is a flexible goose-neck attachment 24. The goose-neck attachment 24 has a distal end attached to the telescoping body 18 and a proximal end having a cap 26 attached thereto. A weighted member 28, such as a ball chain, can be fixed to the cap 26 so that hair retention members 30, such as hair clips, can be attached. The hair retention members 30 can hold the remaining hair upright and away from the palette assembly, while hair layers are spread on the palettes 4 to 4-7.

In accordance with one aspect, the free-standing assistant 16 can also include at least one bracket 32 on the telescoping body 18 for mounting one or more trays or baskets 34, and for holding the implements for coloring and/or cutting. The tray or basket 34 can be used to hold hair tools, such as the application brushes 46 or the hair retaining members 30 used in the method of hair cutting and coloring with the palette assembly 2 of the present invention.

Figure 5:
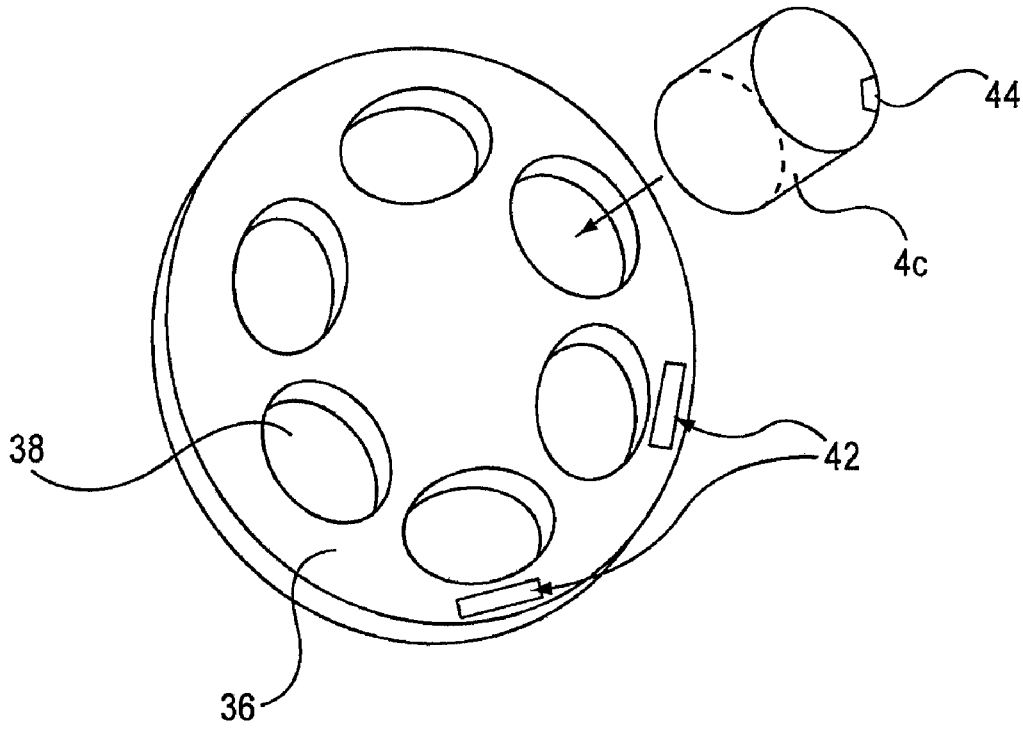
FIG. 5 illustrates the mixing bowl assembly, according to aspects of the present invention.

Aspects of the present invention also include a mixing bowl assembly as shown in FIG. 5. The mixing bowl assembly includes a mixing bowl tray 36 having a plurality of apertures 38 for retaining individual mixing bowls 40. The mixing bowls 40 are separable from the mixing bowl assembly 36 and can be used to mix colors for applying to the hair. The mixing bowl tray 36 includes marking areas 42 on the surface thereof that correspond to each mixing bowl 40. The marking areas 42 allow the stylist to write the coloring formula near the bowl containing said formula. The marking areas 42 can be raised or recessed surfaces or surfaces that are flush with the surface of the mixing bowl tray 36. The marking areas 42 can be formed of a writeable plastic, so that the stylist can mark and erase the formula of the color contained in each mixing bowl 40.

In one aspect, each mixing bowl 40 may include a cutout area 44 for mounting the application brush 46, when the application brush is not in use. In addition, liners can be applied inside each mixing bowl so that the surface of the mixing bowl remains free from the chemicals used in the coloring process. The liners can be formed from plastic or any other material that is non-porous or impervious to moisture and liquids. After use, the liners can be discarded so that the chemicals do not enter the drainage system.

Figure 6A:
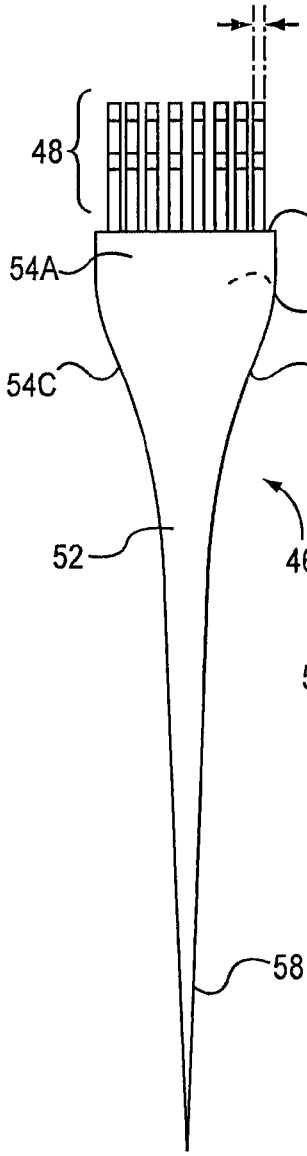
FIGS. 6A and 6B illustrates the application brush, according to aspects of the present invention.
Figure 6B:
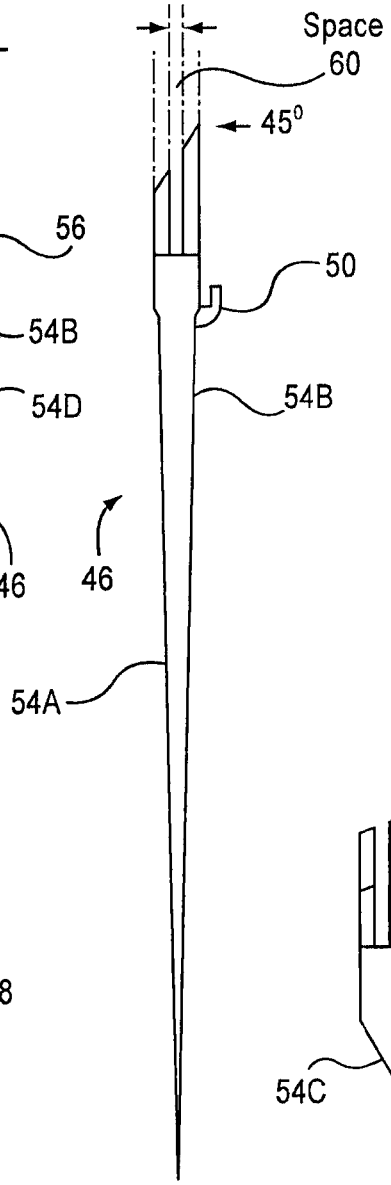

As shown in FIGS. 6A and 6B, in one aspect, the application brush 46 of the present invention includes bristles 48 and a body 52 having a front portion 54A, a rear portion 54B, and side portions 54C and 54D. The body 52 also has a first end 56 for mounting the bristles 48 and a second end 58, which can be held by the stylist. The rear portion 54B of the body 52 includes a hook 50 integrally connected thereto. The body 52 of the application brush 46 can be formed from any material including but not limited to plastic, wood, bone or metal. The hook 50 allows the application brush 46 to rest on the cutout area 44 of the mixing bowl 40. When the hook 50 attaches to the cutout 44 of the mixing bowl 40, the brush can be positioned so that the bristles 48 are disposed within the mixing bowl.

In accordance with one aspect, as shown more clearly in FIG. 6A, the bristles 48 of the application brush can be arranged in two rows with one row extending across the width of the first end 56 on a front side of the brush and a second row extending across the width of an opposite rear side of the brush. As shown in FIG. 6B, illustrating the side view of the application brush, a space 60 is disposed between the two rows of bristles 48. The space 60 is bounded by the two rows of bristles and an upper surface of the first end 56 of the body 52. The space 60 serves as a recess for the color product, so that a greater volume of the color product can be held by the brush, thereby reducing the number of times that the stylist must dip the brush in the color product.

The bristles 48 of the application brush may be cut at an angle with respect to one of the side portions 54C and 54D of the body. As illustrated in FIG. 6B, for example, the angle can be 45 degrees with respect to the side portions 54C, 54D of the body 52. In the illustration of FIG. 6B, the one row of bristles is higher than the other row of bristles. As a result, the higher row of bristles can be used for a precise application of color to a section of hair, and the shorter row of bristles can be used for a broader application of color to a section of hair.

Figure 7:
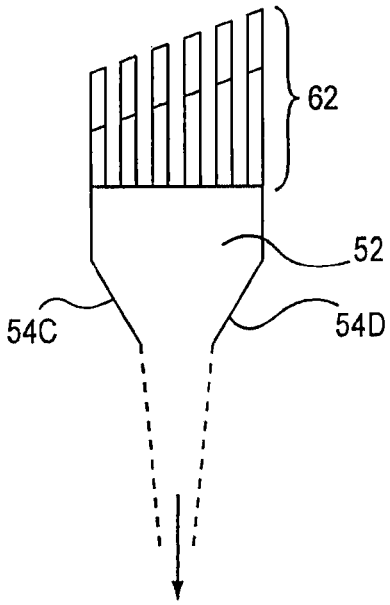
FIG. 7 illustrates an alternative application brush, according to aspects of the present invention.

In addition to the bristles being cut at an angle with respect to the side portion 54D of the body 52, in accordance with one aspect, the bristles can also be cut at an angle with respect to the front and rear portions 54A, 54B of the body. As shown in FIG. 7, the bristles 62 are cut at an angle, such as a 45 degree angle, so that both rows of the bristles are higher at one side, such as side portion 54D and lower at the opposite side, such as side portion 54C. The higher row of bristles can be used for a precise application of color to a section of hair, and the shorter row of bristles can be used for a broader application of color to a section of hair.

Figure 8:
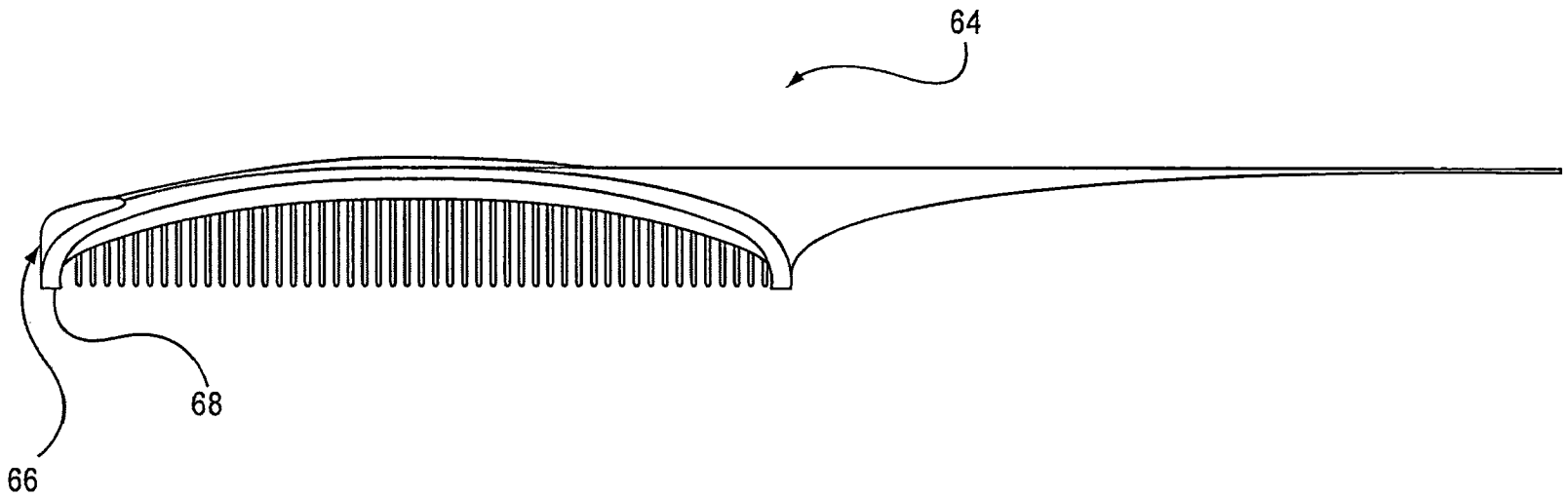
FIG. 8 illustrates the non-residual adhesive member, according to aspects of the present invention.

As shown in FIG. 8, an aspect of the present invention includes a non-residual adhesive member that can be mounted onto a comb 64 that can be used in the advanced method and system for cutting and/or coloring hair. The non-residual adhesive member 66 includes an outer sticky or tacky surface and an inner surface. The non-residual adhesive member 66 is attachable to a comb 64 at a tip portion 68 thereof to allow the tip of the comb to pick up waxed paper, foil, or other thin sheet of material, without the stylist having to shift the position of the comb in-hand. The non-residual adhesive member 66 can be mounted on the comb 64 by an adhesive. Alternatively, the tip 68 of the comb 64 can include a slot for slidably inserting the non-residual adhesive member 66 therein. The non-residual adhesive member 66 can be made from any material including, but not limited to rubber. The comb 64 can be made from any material including, but not limited to plastic, metal, bone or wood.

In the method of cutting and/or coloring hair according to aspects of the present invention, the colors can be prepared in the mixing bowl tray 36. The stylist can select the different colors or shades from the mixing bowl to apply to the hair when the hair is spread on the palettes 4 to 4-7 of the present invention. In preparing the palettes 4 to 4-7, gaskets 6 are applied to the inner edges 4*a* to 4-7*a* of the palettes to secure the palettes to the head to be styled. The hair on the head to be styled is pulled away from the face, for example, in an upward manner above the crown and held in place by free-standing assistant 16, for example, by a stylist, or by other means, such as a rubber band. Each palette necessary to create a particular style is applied to the head. Upon applying each palette 4 to 4-7, layers of the remaining hair held away from the face are released and spread across the palettes. When the first layer of hair is spread across the palette, a desired cut can be made to the first layer, and/or color can be applied to the first layer of hair with the application brush 46 or tool 46. The layer of hair on each palette may be cut and/or styled in accordance with markings on each palette (e.g., lines of different shapes and/or colors, grooves, or any other markings) to ensure that the cut and/or color can be exactly replicated. A separate palette assembly, with cut- and/or color-specific markings may be used for each cut and/or color. Alternatively, a single palette set with markings for several cuts and/or colors may be used for each of the several cuts and/or colors. Foil may be applied to the hair with the non-residual adhesive member 66, as necessary. Second, third and subsequent layers of hair may be applied to respective palettes in the same manner, and may be cut separately or simultaneously with the color being applied to the hair, if desired. After all of the palettes (or a single palette, as the case may be) necessary to create a particular style and/or color are in place, the teeth 14 of the attachment mechanism 10, such as a ladder clip, can be attached to the outer edges of the palettes 4 to 4-7. In accordance with one aspect, attaching the attachment mechanism 10 to the plurality of vertically arranged palettes 4 to 4-7 secures the palettes together in the form of the palette assembly 2 shown in FIG. 1, for color processing, for example.

In one aspect, after color processing, the attachment mechanism 10, such as a ladder clip, can be removed and palettes 4 to 4-7 can be rinsed, removed and reused. The gaskets 6 to 6-7 can be discarded or reused depending on the material and hygienic considerations.

While aspects of the present invention have been described in connection with various features, it will be understood by those skilled in the art that variations and modifications of the aspects of the present invention described above may be made without departing from the scope of the invention. Other aspects will be apparent to those skilled in the art from a consideration of the specification or from a practice of the invention disclosed herein.

The invention claimed is:

1. A palette assembly for styling a person's hair, comprising:

a plurality of substantially flat palettes, each of the palettes comprising a board having a central aperture defined by an inner edge, an outer edge spaced from the central aperture, an upper face and a lower face;

a securing mechanism for securing the palettes about the person's head, the securing mechanism being engageable with the central aperture; and an attachment mechanism in engagement with at least two palettes adjacent the outer edge of the at least two palettes for positioning the plurality of palettes relative to each other, the attachment mechanism comprising a ladder clip having a spine and a plurality of pairs of parallel teeth, the teeth of each pair being spaced apart to accommodate the thickness of a palette and contacting both the upper face and the lower face of the at least two palettes adjacent the outer edge of the at least two palettes.

2. The palette assembly according to claim 1, wherein the securing mechanism is a gasket formed of hypoallergenic rubberized material.

3. A palette assembly in accordance with claim 2 wherein the securing mechanism is adhesively fastened to the inner edge of each palette.

4. A palette assembly in accordance with claim 1, wherein the pairs of teeth extend substantially perpendicular to the spine.

5. The palette assembly according to claim 1, further comprising:

a holding mechanism for holding a portion of the hair away from the palette assembly, the holding mechanism having a base, a telescoping body for height adjustment, the telescoping body extending upwardly from the base and at least one clip for holding the portion of hair, the at least one clip being supported from the body.

6. A palette assembly in accordance with claim 1, wherein at least one of the plurality of palettes is flexible.

7. A palette assembly in accordance with claim 1, wherein at least one of the plurality of palettes is transparent.

8. A method of styling a person's hair, comprising:

a) spreading a first section of the hair on an upper face of a first substantially flat palette; and b) spreading a second section of the hair on an upper face of a second substantially flat palette;

wherein each palette has an opening for positioning the palette about the person's head, a securing mechanism for securing the palettes about the person's head, and an outer edge spaced from the opening;

wherein the first and second palettes are vertically positioned relative to each other in substantially parallel relationship;

wherein at least one substantially flat palette includes a template on the upper face thereof, the template indicating where and how one of the sections of hair should be cut and/or colored;

wherein step of spreading the first or second section of hair is performed by overlying the template with the spread section of hair;

the method further including the step of cutting and/or coloring at least one of the sections of hair according to the template;

the method further including the step of providing a holding mechanism having a base, a telescoping body, the telescoping body extending upwardly from the base and at least one clip for holding a portion of hair, the at least one clip being supported from the body; and the method further including the step of holding a third section of the hair away from the first and second palettes by engaging the third section of hair with the at least one clip of the holding mechanism while performing step b).

9. A method of styling a person's hair in accordance with claim 8, wherein the first palette is placed about the person's head prior to performing step a) and the first section of hair is cut or colored prior to performing step b).

10. A method of styling a person's hair in accordance with claim 9, wherein the opening in the second palette is smaller than the opening in the first palette and the second palette is placed about the user's head after the first section of hair is cut or colored and prior to performing step b).

11. A method of styling a person's hair in accordance with claim 10, further including the step of cutting or coloring the second section of hair after performing step b).

12. A method of styling a person's hair in accordance with claim 8, wherein the holding mechanism includes a gooseneck extending from the telescoping body, the at least one clip being supported from the goose neck.

13. A method of styling a person's hair, comprising:

a) spreading a first section of the hair on an upper face of a first substantially flat palette; and b) spreading a second section of the hair on an upper face of a second substantially flat palette;

wherein each palette has an opening for positioning the palette about the person's head, a securing mechanism for securing the palettes about the person's head, and an outer edge spaced from the opening;

wherein the first and second palettes are vertically positioned relative to each other in substantially parallel relationship;

wherein at least one substantially flat palette includes a template on the upper face thereof, the template indicating where and how one of the sections of hair should be cut and/or colored;

wherein step of spreading the first or second section of hair is performed by overlying the template with the spread section of hair;

the method further including the step of cutting and/or coloring at least one of the sections of hair according to the template;

the method further including the step of providing an attachment mechanism having a spine and a plurality of pairs of teeth, the teeth of each pair being spaced apart to accommodate the thickness of a palette, the method further including the step of engaging portions of the first and second palettes adjacent the outer edges of the first and second palettes between selected pairs of teeth prior to performing step b).

14. A method of styling a person's hair in accordance with claim 13, wherein the first palette is placed about the person's head prior to performing step a) and the first section of hair is cut or colored prior to performing step b).

15. A method of styling a person's hair in accordance with claim 14, wherein the opening in the second palette is smaller than the opening in the first palette and the second palette is placed about the user's head after the first section of hair is cut or colored and prior to performing step b).

16. A method of styling a person's hair in accordance with claim 15, further including the step of cutting or coloring the second section of hair after performing step b).

17. A palette assembly for styling a person's hair, comprising:

a plurality of substantially flat transparent palettes, each palette comprising a board having an inner aperture and an outer edge spaced from the inner aperture, the inner aperture of each palette being configured to conform to the shape of the person's head at a different elevation such that the inner aperture of a lower palette is larger than the inner aperture of an adjacent palette positioned above, with the inner apertures of each successive palette being progressively smaller, the assembly further including a securing mechanism for securing each of the palettes about the person's head, the securing mechanism being engageable with the inner aperture of each substantially flat transparent palette, the palette assembly further including an attachment mechanism for positioning the plurality of palettes relative to one another, the attachment mechanism comprising a ladder clip having a spine and a plurality of pairs of parallel teeth which extend substantially perpendicular to the spine, the teeth of each pair being spaced apart to accommodate the thickness of a palette and contacting opposite faces of the at least two palettes adjacent the outer edge of the at least two palettes.

18. The palette assembly according to claim 17 wherein at least one of the palettes has a template comprising markings or grooves on the upper face of the at least one palette for coloring and/or cutting the hair.

19. A palette assembly in accordance with claim 17, wherein at least one of the plurality of palettes is flexible.

20. A palette assembly in accordance with claim 17, wherein the securing mechanism comprises a gasket formed of hypoallergenic rubberized material.

* * * * *